US007299798B2

(12) United States Patent
Flanagan

(10) Patent No.: US 7,299,798 B2
(45) Date of Patent: Nov. 27, 2007

(54) FRIENDLY FIRE ARCHERY BOW

(76) Inventor: Edward Jay Flanagan, 19420 S. Oakley Rd., Oakley, MI (US) 48649

( * ) Notice: Subject to any disclaimer, the term of this patent is extended or adjusted under 35 U.S.C. 154(b) by 144 days.

(21) Appl. No.: 11/256,142

(22) Filed: Oct. 24, 2005

(65) Prior Publication Data

US 2007/0089722 A1 Apr. 26, 2007

(51) Int. Cl.
*F41B 5/00* (2006.01)

(52) U.S. Cl. ..... 124/86

(58) Field of Classification Search ..... 124/23.1, 124/25.6, 86, 88

See application file for complete search history.

(56) References Cited

U.S. PATENT DOCUMENTS 5,352,146 A * 10/1994 Shuart ..... 446/397
5,419,304 A * 5/1995 Pardue ..... 124/86
5,431,590 A * 7/1995 Abbas ..... 446/207
5,704,154 A * 1/1998 Galfidi, Jr. ..... 42/90
5,964,054 A * 10/1999 Galfidi, Jr. ..... 42/90
6,240,671 B1 * 6/2001 Galfidi, Jr. ..... 42/90
6,499,478 B1 * 12/2002 Perez ..... 124/86
2005/0075042 A1 * 4/2005 Vaicunas et al. ..... 446/418
2006/0246815 A1 * 11/2006 Simone ..... 446/213

* cited by examiner

*Primary Examiner*—John A. Ricci
(74) *Attorney, Agent, or Firm*—Gifford, Krass, Sprinkle, Anderson & Citkowski, P.C.

(57) ABSTRACT

Friendly fire archery bow, is the solution for the archery bow hunter to remain undetected while shooting at game animals. Or being detected without being recognized as the enemy. This archery accessory is a way to disguise the noise an archery bow makes when fired. The scope of this product is to make an artificial sound that is non threatening to game animals when the archery bow is fired. Or an added bonus is to call or attract more game animals while attempting to harvest the present animals. Edward Flanagan shows three examples of how this can be accomplished. One is the bellow type animal call (12) FIG. 1 activated by bow limb (28) movement when the bow (10) is fired. The call could be crow, turkey, squirrel, deer, fox, duck, and rabbit squealer etcetera. The second is a bellow type animal call FIG. 2 (46) activated by compound archery bow cable movement. The third is a air pump activated animal call FIG. 3 (62) that functions when the bow is fired. This patent by Edward Jay Flanagan is not limited to the means described, any apparatus used for sound masking of the archery bow would be in violation of this patent.

17 Claims, 3 Drawing Sheets

FRIENDLY FIRE ARCHERY BOW

BACKGROUND FIELD OF INVENTION

The present invention relates to archery bow accessories.

BACKGROUND OF PRIOR ART

Bowstrings tend to generate noise when an arrow is fired from the bow. This noise is caused primarily by bowstring vibration. Silencers have been utilized to dampen the vibrations of bowstrings example being found in U.S. Pat. No. 6,446,620 B1. It has been observed that known bow string silencers cause arrow speed loss, an undesirable consequence of dampening the bowstring vibration. Furthermore silencers only reduce the noise made by the bow. A bow being fired with silencers can still be clearly heard at a distance.

OBJECTS AND ADVANTAGES

Accordingly, several objects and advantages of my archery accessories are.

(a) If you were to use my accessory without silencers your arrow speed would be faster. The weight of the silencers on the string slows the feet per second on the arrow slightly. If you disguise the noise made, you may not need silencers.

(b) It is common for deer to panic when bow is heard being fired. A deer's reflex time is faster than the fastest bow made. So if the bow isn't heard the game animals may not panic.

(c) This accessory will prevent game nearby from panic when you are shooting at game that is present. Your success could increase. For instance you could shoot at a less desired target like a rabbit and not scare away an undetected approaching big buck.

(d) Game animals being fired at may not realize it and may stick around for a second shot.

(e) Do to a deer's quick reflex time; a non-panicked deer is less likely wounded and lost.

(f) A shot animal that doesn't know it may not run away. It could very likely pass away right in front of the hunter. No tracking or chance of lost game. For someone not skilled in this art might say , how could an animal not know it's been shot. If a razor arrow passes between the rib bones at high speed there is little resistance and nearly no pain. If the deer doesn't hear the bow fire it might not run away. The inventor of this archery accessory has witnessed this.

(g) With the right attachment the cover sound could be an attractant. For instance a deer grunt noise when the bow is fired during a deer hunt.

(h) Added bonus when you shoot a deer and he knows he's been shot, and he makes a commotion getting away. If your bow grunts like a deer and there is a deer to be seen by other deer. It is more likely to draw a second buck in to see what's going on. Grunt calls are more affective if a buck has visual conformation. Further objects and advantages of my invention will become apparent from a consideration of the drawings and ensuing description.

DISADVANTAGE OF PRIOR ART (a) Silencers reduce arrow speed slightly.

(b) Silencers only help reduce noise, a archery bow being fired can still be clearly heard at a distance.

DISADVANTAGE OF CURRENT INVENTION (a) Limb mounted animal call in FIG. 1 if it is built to heavy it could affect archery bow accuracy. Possible counter weight on other limb could be a solution.

(b) Limb mounted animal call in FIG. 1 it's weight could slow arrow feet per second, unknown by inventor at this time.

REFERENCE NUMERALS IN DRAWINGS FIG. 1

10 Archery compound bow

12 Bellow type animal call

14 Slightly flexible fiberglass rod

16 Cable harness

18 String

20 Cable guard

22 Cable guard slide

24 Cam or wheel

26 Cam or wheel

27 Distal end of first limb

28 First limb

30 Limb fastener bolt

31 Limb end

32 Top end of riser

33 riser

34 Cushion plunger accessory hole

36 Handle

38 Stabilizer

39 Bottom end of riser

40 Limb end

41 Limb fastener bolt

42 Second limb

43 Distal end of second limb

REFERENCE NUMBERS IN DRAWING FIG. 2

Figure 1:
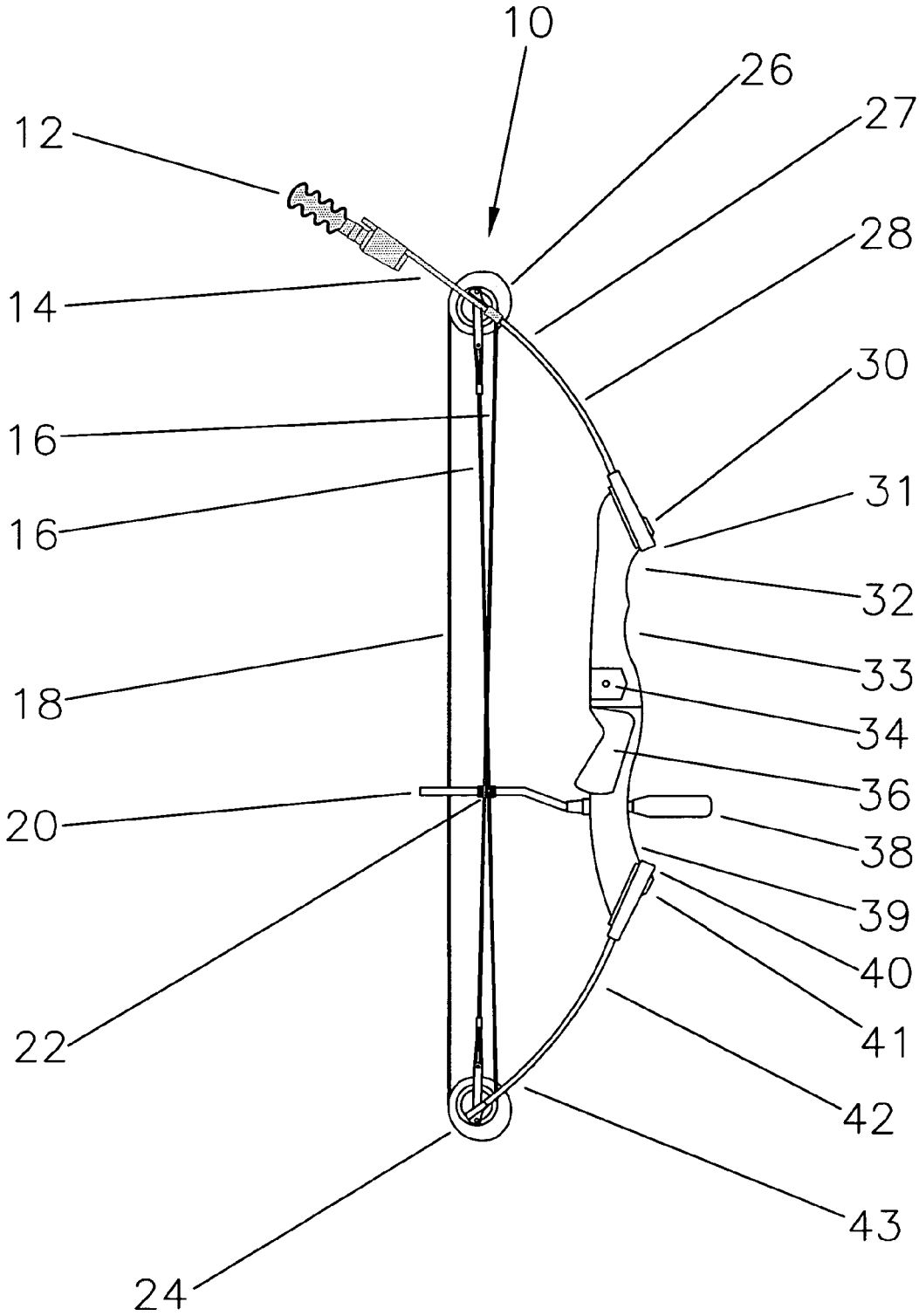
FIG. 1 is a side view of an archery bow assembly with animal call affixed to the end of the bow limb.

Numbers not in FIG. 1

13 Archer

19 Arrow

44 Striker

46 Bellow type animal call

48 Fastener for animal call

50 Bracket

52 Bolt

REFERENCE NUMBERS IN DRAWING FIG. 3

Figure 2:
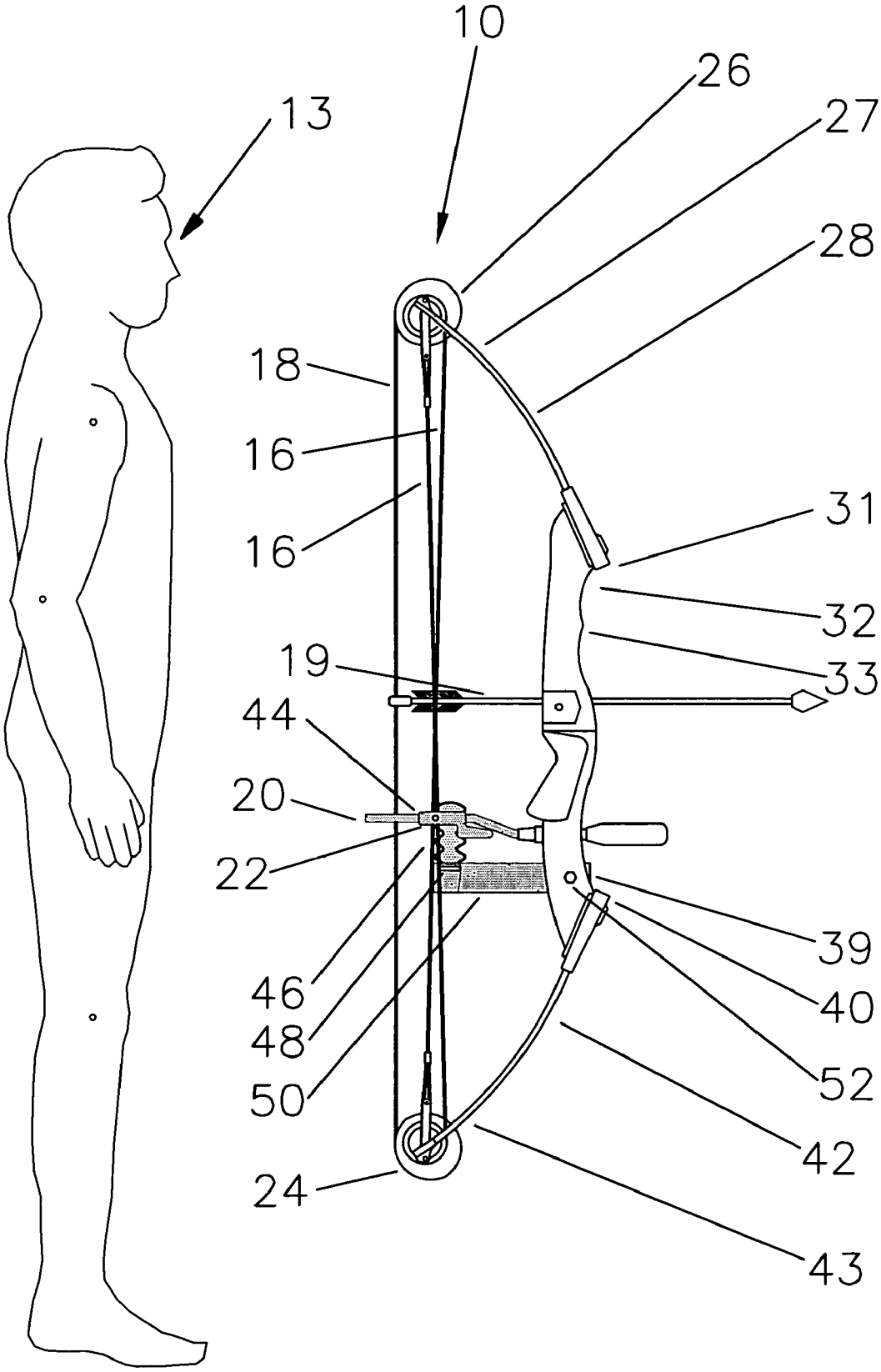
FIG. 2 is a side view of an archery bow assembly with animal call held by a bracket, activated by a striking arm affixed to the cable guard slide.

Numbers not in FIG. 1 and FIG. 2

54 Pump rod

56 Attachment bracket

58 Cylinder

60 Air speed regulator

62 Animal call

64 Pump head

66 Spring

SUMMARY OF INVENTION

The friendly fire archery bow, involves a way to camouflage the threatening noise a archery bow makes when fired. This could be referred to as sound masking. That would be creating a common, friendly or attracting sound to hide an undesirable noise. Any one skilled in the art would recognize that this invention could be applied to archery bow, archery cross bow, archery compound bow and archery recurve bow.

Detailed Description of FIG. 1

Referring to the drawings, FIG. 1 illustrates a compound archery bow 10. Having a riser 33 with the first and second limbs 28,42 extending from opposing riser ends 32,39 of the riser 33. The first limb 28 has a first limb end 31 connected to the riser end 32 of the riser 33 and a second distal limb end 27. Similarly the second limb 42 has a first limb end 40 connected to the opposite riser end 39 of the riser 33 and a second distal limb end 43. A wheel or cam 24-26 is rotatably attached to each distal limb end 27,43 of the limbs 42,28. Additionally a harness or cable system 16 and a bowstring 18 are wound around and between each wheel or cam 24,26 and pulled in tension by the limbs 28,42. There is a cable guard 20 that holds the cable harness 16 out of the path of the arrow 19 seen in FIG. 2. On one side of the cable guard is a cable guard slide 22 that ensures smooth sliding of cable harness 16 as the bow 10 is drawn and fired. Limb fastener bolts 30,41 are used to change poundage on most compound bows. In the center of the riser 33 is a cushion plunger accessory hole 34 this is used for tuning the bow 10. Also in the middle of the riser 33 is a handle 36 which is held by the left hand of a right handed archer. At the front of the riser 33 is a stabilizer 38 which helps with the balance of the bow 10. The first embodiment in FIG. 1 of the archery accessory is a bellow type animal call 12, fastened to a flexible rod 14. Which in turn is fastened to the distal end of the limb 27.

Operation FIG. 1

How it all works is when the bow is drawn back by the string 18 the distal limb ends 27, 43 bend towards each other slowly increasing tension. When the string 18 is released to fire an arrow the distal limb ends 27,43 snap forward rapidly. This sudden movement whips the animal call 12 back and forth on it's semi flexible rod 14. When the bellow on the animal call 12 is shaken it moves air causing the animal call 12 to make it's sound. Enough sound to hide the string 18 vibration noise.

Detailed Description of FIG. 2

Referring to the drawings, FIG. 2 illustrates a compound archery bow 10. Having a riser 33 with first and second limbs 28,42 extending from opposing riser ends 32,39 of the riser 33. The first limb 28 has a first limb end 31 connected to the riser end 32 of the riser 33 and a second distal limb end 27. Similarly the second limb 42 has a first limb end 40 connected to the opposite riser end 39 of the riser 33 and a second distal limb end 43. A wheel or cam 24,26 is rotatably attached to each distal limb end 27,43 of the limbs 42, 28. Additionally a harness or cable system 16 and a bow string 18 are wound around and between each wheel or cam 24, 26 and pulled in tension by the limbs 28, 42. There is a cable guard 20 that holds the cable harness 16 out of the path of the arrow 19. A bracket 50 is a way to hold a animal call 46 in its proper location. The animal call 46 in this case is attached to the animal call bracket 50 with a plastic rip tie type fastener 48. The animal call bracket 50 is fastened to the bow riser 33 with a bolt 52. Cable guard 20 is a metal rod with a slight bend threaded to the riser 33. It's purpose is to hold the cables 16 out of the path of the arrow 19. The cable guard slide 22 is shown in FIG. 1 but in FIG. 2 it is located behind the striker 44. A striker 44 is fastened to the cable guard slide 22. The bow 10 is drawn and fired by archer 13.

Operation FIG. 2

How it works is when the string 18 is drawn, the distal limb ends 27, 43 bend in and toward the archer 13. In this process the cables 16 and cable slide 22 move back toward the archer 13. The bellow striker 44 is affixed to the cable slide 22. So as the bow is drawn the cable guard slide 22 and striker 44 moves past the bellow 46 slowly. As the string 18 is released to fire the arrow 19, the striker 44 moves forward slaps against the bellow 46 at high speed whipping it back forth. The movement created moves the air through the animal call inside the bellow 46. Creating the cover sound intended to hide the string vibration noise.

Figure 3:
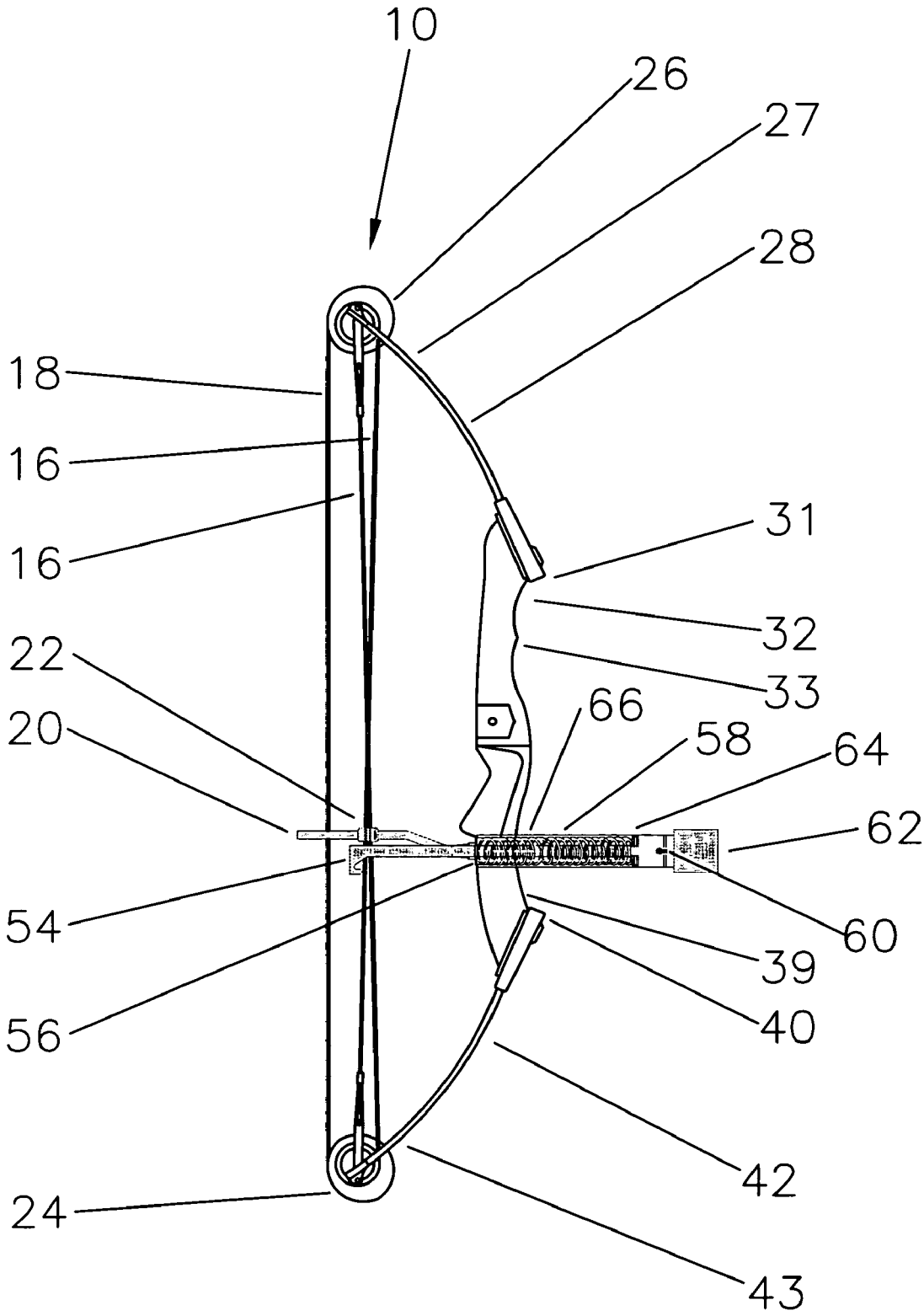
FIG. 3 is a side view of an archery bow assembly with a sound masking device, activated by a spring loaded cylinder that pushes air through an animal call the instant the bow is fired.

Detailed Description of FIG. 3

Referring to the drawings in FIG. 3 illustrates a compound archery bow 10 having a riser 33 with a first and second limbs 28, 42 extending from opposing riser ends 32, 39. The first limb 28 has a first limb end 31 connected to the riser end 32 of the riser 33 and a second distal limb end 27. Similarly the second limb 42 has a first limb end 40 connected to the opposite end 39 of the riser 33 and a second distal limb end 43. A wheel or cam 24, 26 is rotatably attached to each distal limb end 27, 43 of the limbs 42, 28. Additionally a harness or cable system 16 and a bow string 18 are wound around and between each wheel or cam 24, 26 and pulled in tension by the limbs 28, 42. In FIG. 3, there is a attachment bracket 56 that fastens to the riser 33. It is secured under the fastener nut that secures the cable guard 20. Attachment bracket 56 then reaches out to the cylinder 58 and secures the assembly rear end to the riser 33. The middle of the cylinder 58 is secured to the stabilizer 38 not shown in FIG. 3 because it is behind the cylinder 58 from this point of view. To view the stabilizer 38 see FIG. 1. There is a pump rod 54 extending out of the rear of the cylinder 58 and is hooked over the cable harness 16. The front end of the pump rod 54 has a pump head 64 attached to it. The pump head 64 is located inside the cylinder 58. The spring 66 applies pressure to the pump head 64. Inside the cylinder 58 is a air speed regulator 60. At the end of the cylinder 58 is a air movement activated animal call 62.

Operation FIG. 3

FIG. 3 is the third embodiment of the sound masking archery accessory. How friendly fire works is when the string 18 is drawn, the distal limb ends 27, 43 bend in and toward the archer 13. In this process the cable 16 move back toward the string 18. Since pump rod 54 hooks over the cables 16 it pulls the pump rod 54 back compressing the spring 66 behind pump head 64. When the bow 10 is fired the cables 16 move forward rapidly leaving the hook end of the pump rod 54 behind. Before the arrow even leaves the bow the spring 66 pushes the pump head 64 ahead creating air pressure in the cylinder 58. Then the air leaks through the air speed regulator 60 at a controlled speed. A speed at which animal call 62 works the best. To disable during practice unhook pump rod 54 off the cable harness 16.

Summary of Ramifications and Scope

During the ramification period I purchased a large variety of animal calls. I affixed a bellow to different types of calls like squirrel and crow, that were activated by moving air. I built many different bracket configurations that put the bellow in the path of the moving parts of the archery bow during the firing process. The moving archery bow parts move the bellow, which moves air when struck or compressed, which activates the animal sound. FIG. 1 and FIG. 2 illustrates bellow type that I got to work the best. The grunt or deer call did not work with the bellow so I created the pump type seen in FIG. 3, after some time changing calls, and adjusting air speed and volume, I got one in particular working excellent. All three embodiments are easily disarmed if not wanted during practice. In the third embodiment FIG. 3 the deer call 62 is detachable so you can change deer calls or add different calls.

Any avid archery bow hunter knows he is at a huge advantage if he is undetected while hunting. If you fire a bow in quiet conditions say no wind in a wilderness area, most deer within 100 yards will know your hunting. But if your bow sounds like a buck when fired maybe another buck will come in and see if a buck is on his breeding turf. Odds of success just increased.

Physical Forms my Invention Could Take (a) Archery bow activated rubber bellow type animal call as disclosed in FIG. 1 and in FIG. 2.

(b) Archery bow activated air cylinder type animal call as disclosed in FIG. 3.

(c) Device attached to archery bow string or moving parts that could squeak or whistle like a bird or cluck like a turkey could make a cover sound.

(d) A triggered spring or rubber band loaded device could imitate natural sounds through friction of the same or different materials. For example a box type turkey call is rubber band aided, but the sound is displayed from two pieces of chalk covered wood rubbing against each other.

(e) A electronic or electric device could easily be made by people in that field. To make a cover sound that is triggered when the archery bow is fired.

(f) The air pump in FIG. 3 could be reversed to create vacuum operated calls in the same fashion.

(g) Compressed air containers could be used as air supply to activate calls. This invention could take many forms to create a cover sound. It shouldn't be limited to the types shown.

What is claimed is:

1. An archery bow comprising:

a frame having first and second limbs extending outwardly from opposite ends of a riser;

a bow string tensioned between the first limb and the second limb;

a sound producing device that produces sound when air passes therethrough, the sound producing device being operatively coupled to the frame of the bow and having air forced therethrough to produce sound automatically in response to a release of the bow string as the archery bow is fired.

2. The archery bow as set forth in claim 1, wherein the sound producing devices is coupled to the riser.

3. The archery bow as set forth in claim 2 including a spring loaded air pump triggered when the archery bow is fired, the air pump moving a controlled rate of air trough the sound producing device in response to firing of the bow and applying substantially no force upon the bow string as the bow string is released during a firing of the archery bow.

4. The archery bow as set forth in claim 2 including at least one pulley wheel pivotally coupled to one of the limbs of the frame and a cable harness extending between the at least one pulley wheel and the other one of the limbs of the frame.

5. The archery bow as set forth in claim 4 including a cable guard extending outwardly from the riser of the frame.

6. The archery bow as set forth in claim 5 including a cable guard slide coupled to the cable harness and slidably engaged with the cable guard.

7. The archery bow as set forth in claim 6 including a striker fastened to the cable guard slide and engaging the sound producing device when the bow is tired thereby activating the sound producing device in response to a firing of the bow.

8. The archery bow as set forth in claim 6, wherein the sound producing device includes an axially displacable shaft for actuating the sound producing device.

9. The archery bow as set forth in claim 8, wherein the shaft is coupled to the cable harness, the shaft being despicable with the cable guard slide so as to actuate the sound producing device in response to a firing of the bow.

10. The archery bow as set forth in claim 9, wherein the shaft is displaced in generally the same direction in which the bow is fired to actuate the sound producing device.

11. The archery bow as set forth in claim 9, wherein the shaft of the sound producing device includes a hook that hooks onto the cable harness and allows the sound producing device to be activated in response to tensioning of the bow.

12. The archery bow as set forth in claim 11, wherein the hook is open in a direction in which the cable harness is displaced when the bow string is released during a firing of the archery bow, the sound producing device applying substantially no force upon the cable harness as the bow string is released during a firing of the archery bow.

13. The archery bow as set forth in claim 1, wherein the sound producing device is supported on a distal end of a rod extending from one of the first and second limbs of the archery bow.

14. The archery bow as set forth in claim 1, wherein the sound producing device is connected to and extends outwardly from a distal end of one of the first and second limbs, the sound producing device moving with the distal end as the one of the first and second limbs bends in response to increased tensioning of the bow string, the sound producing device being accelerated with the distal end as the tension in the bow string is released so as to force air through the sound producing device and produce sound sufficient to substantially mask the noise associated with the release of the bow string.

15. The archery bow as set forth in claim 14 including a flexible rod coupled to the distal end of the one of the first and second limbs.

16. The archery bow as set forth in claim 15, wherein the sound producing device is fixedly secured to the flexible rod.

17. The archery bow as set forth in claim 14, wherein the sound producing device is an animal call.

* * * * *

UNITED STATES PATENT AND TRADEMARK OFFICE

CERTIFICATE OF CORRECTION

PATENT NO. : 7,299,798 B2
APPLICATION NO. : 11/256142
DATED : November 27, 2007
INVENTOR(S) : Edward Flanagan It is certified that error appears in the above-identified patent and that said Letters Patent is hereby corrected as shown below:

Column 6, Line 10

Delete “devices”; insert --device--.

Signed and Sealed this

Twentieth Day of May, 2008

JON W. DUDAS
*Director of the United States Patent and Trademark Office*